United States Patent [19]

Walford

[11] 4,045,847

[45] Sept. 6, 1977

[54] APPARATUS FOR THE MANUFACTURE OF WEFT INSERTED NON-WOVEN FABRICS

[76] Inventor: Richard L. Walford, 576 Walnut Hill Road, Thomaston, Conn. 06787

[21] Appl. No.: 485,490

[22] Filed: July 3, 1974

Related U.S. Application Data

[63] Continuation-in-part of Ser. No. 77,514, Oct. 2, 1970, abandoned.

[51] Int. Cl.[2] ..... D04H 3/04

[52] U.S. Cl. ..... 28/101; 156/439

[58] Field of Search ..... 28/1 CL; 66/84 A; 156/439, 440

[56] References Cited

U.S. PATENT DOCUMENTS

| | | | |
|---|---|---|---|
| 2,842,829 | 7/1958 | Buckles | 28/1 CL UX |
| 3,154,452 | 10/1964 | Hartbauer | 156/439 X |
| 3,493,455 | 3/1970 | LeBolt et al. | 28/1 CL UX |
| 3,505,712 | 4/1970 | Servage | 28/1 CL |
| 3,563,061 | 2/1971 | Furst | 66/84 A UX |
| 3,593,394 | 7/1971 | Bolles | 28/1 CL |
| 3,594,256 | 7/1971 | Schuller et al. | 66/84 A UX |
| 3,616,657 | 11/1971 | Furst | 66/84 A |
| 3,636,731 | 1/1972 | Jones | 28/1 CL X |
| 3,643,471 | 2/1972 | Furst | 66/84 A |
| 3,675,285 | 7/1972 | Atwood et al. | 28/1 CL |
| 3,701,267 | 10/1972 | Furst | 66/84 A UX |

FOREIGN PATENT DOCUMENTS

| | | | |
|---|---|---|---|
| 589,790 | 12/1959 | Canada | 156/439 |
| 481,244 | 12/1969 | Switzerland | 28/1 CL |

*Primary Examiner*—Robert R. Mackey

[57] ABSTRACT

Weft yarn for weft insertion in a machine for non-woven fabrics with one or more sets of warp yarns is fed through an intermittent tensioning device to a rotating hollow wand through which the yarn passes and which lays successive wefts on hooks on weft carrying chains, the thread being transferred on one side to a first rotating finger which transfers it onto a second forked rotating finger which loops the yarn around a hook. Preferably, on one side, there are additional fingers which cause the yarn to make one half turn, and on the other side there is a rotating finger with two hooks which straddle the rotating forked finger and transfer the yarn to weft hooks on the traveling chain without turning the yarn. Tension is intermittently applied at the points where yarn is transferred from the wand to the fingers to prevent yarn overshoot. The hooks on their chains carry the wefts over warp yarns, or between upper and lower warp yarns, and the hooks are angled so that only at the far ends of the chains the weft loops slip off. In one modification a roller causes the weft and warp threaded fabric to dip below the surface of a coating or adhesive, the roller being shorter than the distance between chains so that adhesive is not applied to the hooks.

8 Claims, 37 Drawing Figures

INVENTOR
R. L. WALFORD

BY Michael T. Fisher

ATTORNEY

APPARATUS FOR THE MANUFACTURE OF WEFT INSERTED NON-WOVEN FABRICS

RELATED APPLICATIONS

This application is a continuation-in-part of my earlier co-pending application Ser. No. 77,514, filed Oct. 2, 1970. This earlier application is now abandoned.

BACKGROUND OF THE INVENTION

Non-woven fabrics have achieved very large use where they are suitable because they can be made at high speed of low cost raw material, which reduces the final cost of the fabric far below woven or knitted fabrics. Two general types of non-woven fabrics are those where the fibers are felted and those in which weft yarns are laid across warp yarns or are looped around a set of warp yarns. Sometimes this is effected by spiraling the weft yarn around warp yarns. It is with the second general type of non-woven fabric, i.e. the type with laid in weft yarns, that the present invention deals.

In general non-woven fabrics of layers of warp and weft yarns are subjected to treatment with coating compositions, and particularly adhesive compositions, which glue the weft yarns and warp yarns together, thus locking them. Where the dimensional stability of locking is not essential but where it is desired to alter the surface of the yarns by coatings, this has also been effected. In general the two types of fabrics just described are really the same, as whether there is actually adhesive locking or mere coating of the fibers depends on the chemical and physical nature of the coating compositions with which the fabric is treated.

Spiraling weft thread around a layer of warp threads may be effected in various manners, for example by a spiral wrapping, a typical example of which is described in the U.S. Pat. No. 3,041,230 to Diehl, or by feeding spiral weft loops along two outer warp threads acting as selvage threads by having the selvage threads pass through a rotating corkscrew-shaped scroll which carries loops of weft thread and deposits them across these warp threads. This modification of the spiraling of weft threads around warp threads is described, for example, in the U.S. Pat. No. 3,422,511 to Seguin.

Generally where weft thread is spiraled around warp threads, at this point the product may be considered as a multi-layer laminate with warp threads between layers of weft threads. The various modifications of the spiraled weft thread type of fabric are useful products and can be practically produced. As with many products of practical utility, there are certain characteristics which are not ideal. First, friction in the scrolls can damage certain yarns, such as glass yarn. Secondly, considering only non-woven fabrics which are held together by treatment with adhesive compositions, it is desirable to have the weft threads and the warp threads held in a definite predetermined position as they are treated with the adhesive, followed by nip rolls and heating or other means for setting the adhesive or binder. When the weft thread is spiraled around some or all of the wrap threads, the resulting non-woven fabric must move to adhesive treatment operations, and when so moving the unlocked warp threads and the spiral weft threads can move over each other. In other words, the warp threads may move sideways of the fabric, resulting in some warps crossing each other, and the weft spirals can move varying the closeness with which the spirals are laid. For many fabrics slight moving before locking by adhesives is not serious, and so this characterisitic may be unobjectionable in such fabrics. However, for certain fabrics where it is desired to maintain exact alignment of warp threads and weft threads, this constitutes a drawback.

Laying of parallel yarns as a broad concept is not unknown in the non-woven fabric art. For example, a mechanism is described in the U.S. Pat. No. 3,390,439 to Kalwaites. This leads yarn from a supply to hooks on a pair of diverging hook carrying chains, and at the point of maximum divergence the parallel line loops drop off the hooks onto a conveyor belt. With certain types of strong yarns or yarns which are not excessively lively, that is to say, which do not tend to twist or snarl, quite rapid operation is possible. The patent is not particularly concerned with non-woven fabrics which also have warp threads; it is primarily concerned with cross laying the yarns for yarn reinforced papers and the like, where they are applied, usually with binders, to the paper. If, however, the parallel yarns on the conveyor belt are laid across warp yarns to produce a warp and weft non-woven fabric, the friction of the warp yarns can cause some movement of the parallel weft yarns before adhesive locking, and so while there is no problem of moving or crossing warp yarns, there is a problem with the weft yarns on the conveyor when they are transferred to the moving warp yarns before the resulting fabric is locked. Here again useful fabrics or materials represent some degree of compromise, which with fabrics for certain purposes is not desirable.

SUMMARY OF THE INVENTION

The present invention is directed to apparatus for making fabrics, more particularly non-woven fabrics of warp and single or multiple weft threads or yarns in which preferably the yarns are bonded in the fabric, for example by adhesive, although other forms of bonding will be mentioned below as alternatives or further illustration of a general bonding means, without any risk of displacement in a transverse direction for either the warp or weft threads. In other words, there is no compromise of one characteristic to achieve the optimum of another characteristic. At the same time, high speed is possible; and in more specific aspects, any weft yarns, even the most difficult by reason of liveliness, brittleness and other characterisitics, can be handled.

From the apparatus aspect of the invention, it is an advantage that the apparatus of the present invention, may be used to produce cheaply and in large output non-woven fabrics even though the end use of the fabrics may not require the maximum perfection of alignment of the yarns which can be obtained by the present invention. It will be seen from a further more detailed description below that substantially ideal alignment is obtainable with just as high speed and low cost as a less perfect alignment, and so a single machine can produce non-woven fabrics of optimum quality for all uses, even though for some of the uses a less perfect quality would be acceptable.

Essentially the present invention lays wefts at high speed on hooks on carrier chains or other carrying means and carries them, in exact alignment, into contact with one or more sheets of warp threads, whereby slippage is avoided. In a preferred modification the weft yarns are parallel and do not cross each other. The warp threads in turn can be maintained separated in an exact alignment by conventional reeds or other elements until they contact the aligned weft yarns. The latter are held against any transverse or longitudinal movement by the hooks and carrier chains until the fabric is complete, and therefore there is no transverse pull on the warp threads as is the case when weft thread is spiraled around the warp threads, even in the modification shown in the Seguin patent. This perfect alignment of the weft threads is rigidly held until the fabric is either bonded by adhesive treatment or held by nip rolls or other means which maintain the fabric in perfect alignment as it goes through them. Then when the fabric is complete, the wefts are released from the carrier hooks, for example by means of a shoe, cutting means, etc. there is never any point where the wefts can move transverse to their aligned direction until the fabric is finally held together, and the same holds true for the warp threads because there is never any transverse pull on them as long as the fabric is being formed.

Another feature which is of importance for high speed operation is the prevention of weft yarn overshoot by intermittent application of tensioning means at the moments when the weft yarn is transferred to the hooks on the carrier chains.

As will be described in detail below in the description of the preferred embodiments, the weft yarn is preferably transferred to hooks on each chain by a moving hollow wand. The wand may turn continuously in one direction or it may oscillate from one chain to the other. If the wand turns continuously, transfer means are provided for transferring the yarn to the hooks on one chain with a half twist. The transfer means to the hooks on the other chain do not produce a half twist. If the wand oscillates, neither transfer introduces a half twist. As the wand rotates or oscillates, the yarn leaving its end moves in simple harmonic motion and, as a result, slows down and actually momentarily stops at the two points where transfer to the hooks on the chains takes place.

In order to prevent yarn overshoot when transferred to the hooks, intermittent tension is applied for a short time to the incoming yarn at these points so that it cannot overshoot by reason of momentum. The tension is then released during the remainder of the motion of the wand from one chain to the other so that there is minimum tension on the yarn.

The rotation of the wand, the actuation of the tensioning means, for example by cam, the rotations of the pairs of fingers and the movement of the carrier chains with hooks are all synchronized and normally are driven through suitable drive means from a single driving source.

As the carrier chains move, the parallel weft yarns around the hooks move forward in alignment to the point at which the parallel weft yarns contact the warp yarns. There may be a single layer of warp yarns and the weft yarns are laid on it, or there may be two or more layers of warp yarn between which the weft yarns are laid to form a sandwich. Where two layers of warp yarns are used in the fabric, they are preferably staggered, so that superficially after the fabric has been made, and preferably bonded, it has the appearance of a woven fabric, though in fact there is no actual weaving and no physical interlocking of the yarns. The warp yarns, with the weft yarns in contact with them, continue to move forward while the weft yarns are still firmly held by the hooks in the carrier chains until the product reaches the point where adhesive or other coating composition or locking is applied.

At this point a shorter roller which does not project as far as the two carrier chains causes the whole fabric to move down slightly and dip below the surface of a coating composition in a trough where it is maintained at constant level, for example by a constant feed with an overflow weir. The fabric then passes between nip rolls which squeeze out excess coating or adhesive composition and, finally, through drying or setting means. Shortly after the fabric leaves the drying means, the hook carrying chains run around end sprockets and the loops of the wefts are released, preferably by a shoe. The chains then continue back with their hooks to pick up fresh weft thread after they have gone around their other sprockets.

After the fabric has passed through the drying means, which have set the coating or adhesive composition, it then goes to conventional take-up rolls, which, of course, should be driven in synchronism with the forward motion of the fabric.

Because of the fact that the weft yarn is not under tension, or at the most is under negligible tension, during the portions of the rotation of the wand where the yarn is pulled out at maximum speed, there is no resistance, or negligible resistance, and the wand can turn at high speed. As the feeding of yarn is in effect in simple harmonic motion, it is moving very slowly at the time of transfer of the weft yarn to the fingers; in fact, at one instant there is actually no motion of the yarn. As a result, tension can be applied at or near this time to prevent overshoot of yarn and assure that the loops are firmly fastened around the angled hooks without subjecting the yarn to undue tension. Of course the auxiliary fingers at one side prevent the yarn from crossing; and as a result, even lively yarn or yarn which has poor strength in certain directions can be used, for example glass fiber, which while it has enormous tensile strength can be easily broken by bending. Breaks in the yarn are eliminated and the machine operates at high speed reliably and continuously. It is possible with suitable yarns to lay down as many as a thousand or more weft yarns per minute, which corresponds to a rotation of the wand of 500, as of course the wand lays two wefts in each full revolution. The high speed permits very economical operation and achieves it without any offsetting disadvantages.

In the preferred embodiments described below, a wand is described as the element stringing the weft yarn from hook to hook. The essential thing is that the element stringing the yarn follows an arc of a circle from one chain to the other. The cord of said arc is substantially equal to the length of a weft. Any equivalent type of stringing element, such as a disc with suitable yarn guide, may replace the wand.

The non-woven fabrics of the present invention need not be used as fabrics per se. They can also be used as reinforcing fabrics for resins and other plastic compositions. For example, if warps are used of very high tensile material, such as, for example, extreme high tensile graphite or, for less extreme uses, glass fiber, the resulting fabric may be used as reinforcement in thermosetting plastics, such as for airplane propeller blades, compressor blades, and the like. The tremendous tensile strength in the direction of the high tensile yarns is fully retained. If the yarns have surfaces compatible with the platics which they reinforce, which sometimes requires treatment with a coating composition, it is not essential that the warp and weft fabrics be bonded because once they are in the reinforced plastic they are held against movement. In such a case the only dimensional strength required is that which permits lamination. In some cases this can be a field where the present invention is used in producing non-woven fabrics in which the weft and warp yarns are not bonded. The fact that the weft yarns are strung parallel without crossing makes non-woven fabrics produced according to the present invention ideal where brittle, high tensile material, such as high modulus graphite, is used as there is no bending of the graphite fibers.

The weft transport is preferably by chains but other carrier means may be used. The hooks are also the preferred retaining means for wefts during transport, but other equivalent means may be used.

DESCRIPTION OF THE DRAWINGS

FIGS. 5A to 10A show diagrammatically positions of the weft yarn transferring wand;

FIGS. 11A to 15A show diagrammatic positions of the wand corresponding to FIGS. 11 to 15, in a manner similar to FIGS. 5A to 10A for the mechanism on the left hand side of the machine;

DESCRIPTION OF THE PREFERRED EMBODIMENTS

Figure 1:
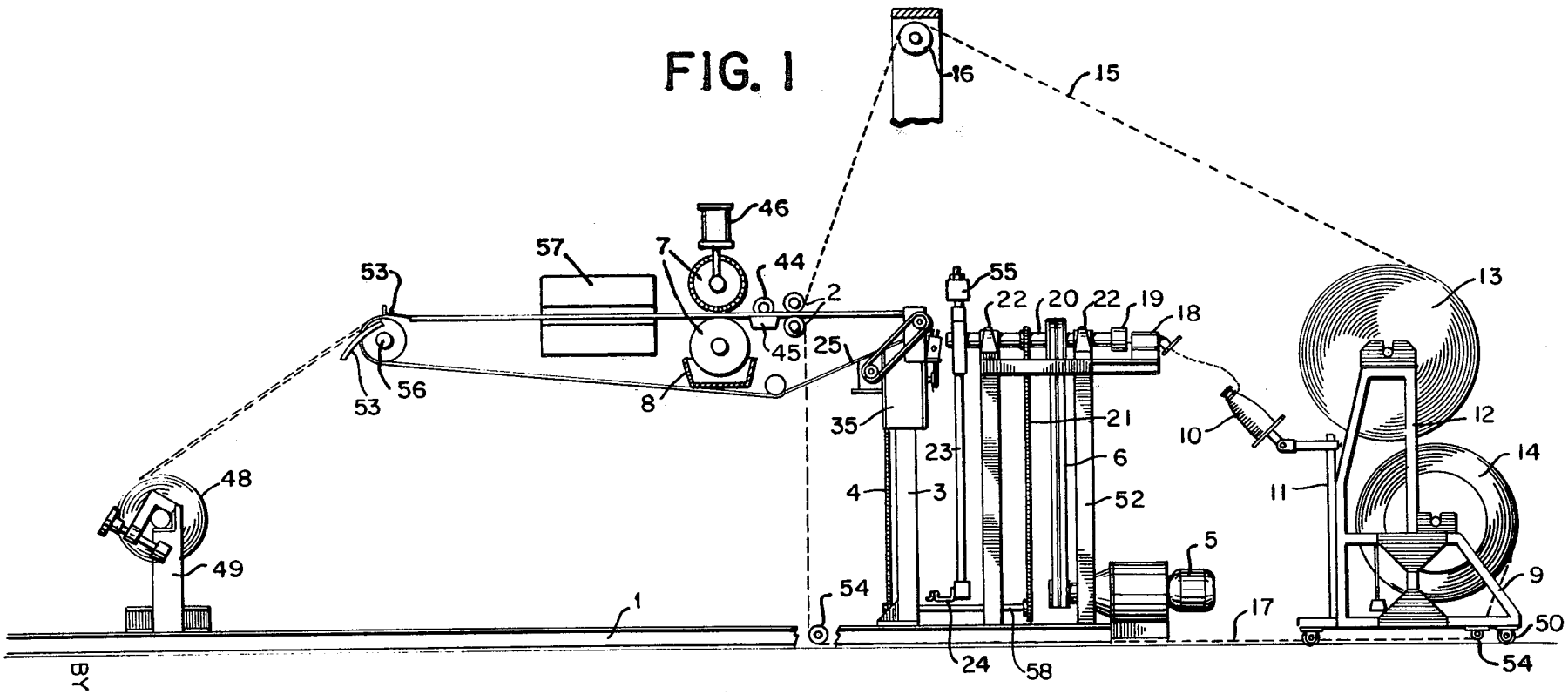
FIG. 1 is an elevation of an overall machine.

In order to simplify the understanding of the operation of the machine of the present invention, it will first be described in connection with FIGS. 1, 1A, 1B, 3 to 15A, and 17 to 20. The detailed description of transfer of yarn from the wand to the hooks on the chain will then be described in more detail in connection with FIGS. 2 to 15A. These figures are referred to in connection with the more general description of the operation and can be identified by reference numerals which are uniform throughout all of the figures of the drawings. Description of an oscillating drive in FIG. 16 will be made at the end of the specification although brief general mention thereof appears also in portions of the description of FIGS. 2 to 15A.

Figure 1A:
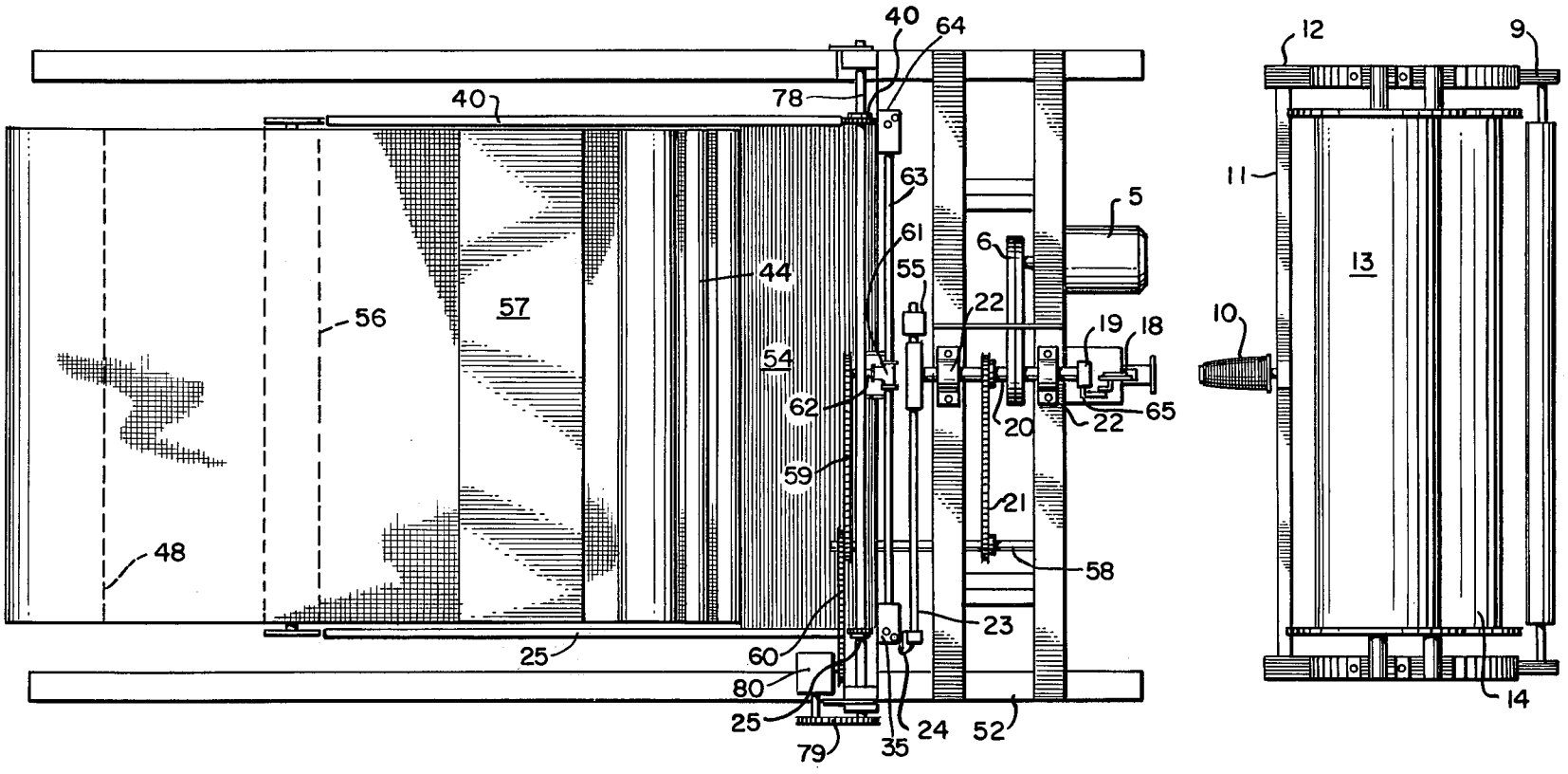
FIG. 1A is a plan view of an overall machine.
Figure 1B:
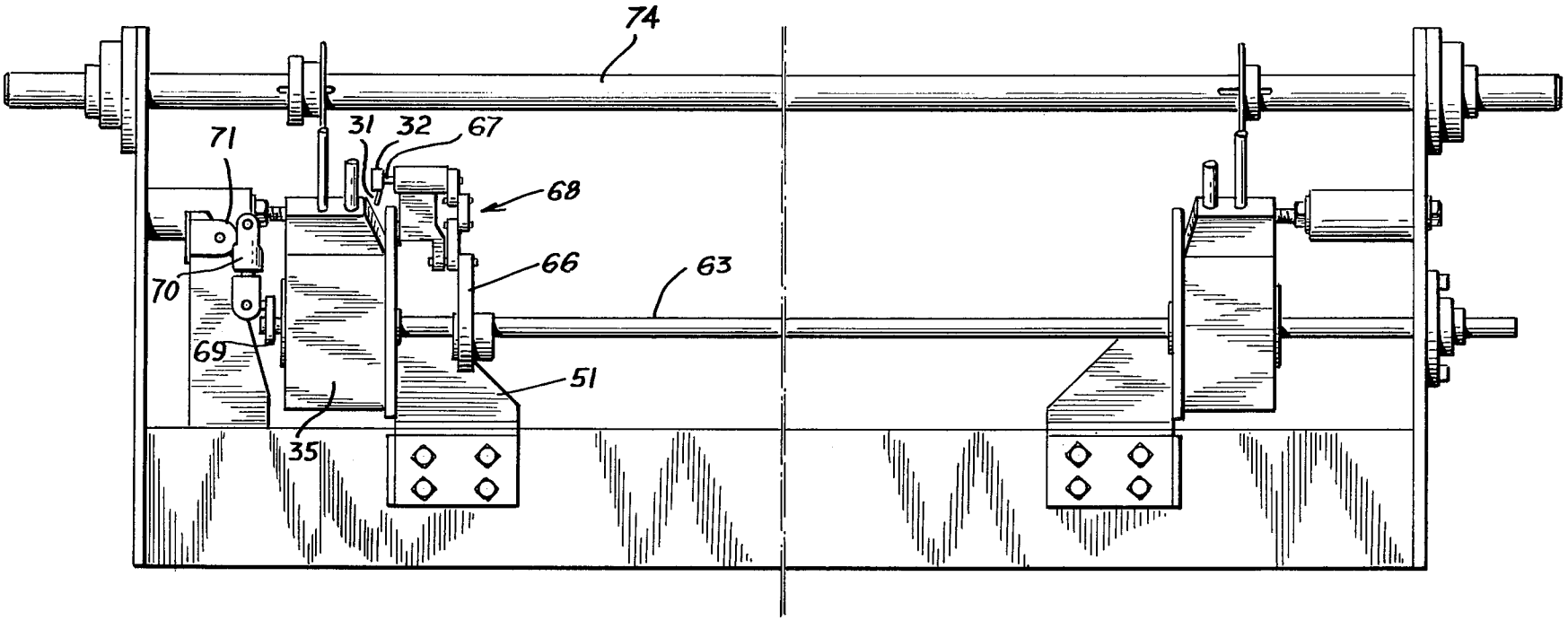
FIG. 1B is an enlarged detail, partly broken away, of cross shafts and drives for yarn transfer as illustrated on FIGS. 1 and 1A.

Looking at FIGS. 1, 1A and 1B, the machine has a base or framework 1 carrying upwardly projecting frames 3, 49 and 52. Upwardly projecting frame portions 9, 11 and 12 are mounted on a carriage with wheels 50. A motor 5 drives the whole machine through chains or notched belts 6, 21 and 4. As a result, all of the moving parts of the machine are synchronized. The drive elements on frame projections 49 are not shown as they do not appear in FIGS. 1, 1A and 1B. They are, however, driven from the main drive.

Frame projection 11 carries supply packages of weft yarn 10; only one package is shown in FIGS. 1 and 1A, but in an actual machine there are several packages connected in sequence so that the machine can run continuously. Warp threads, which are carried by the beams 13 and 14, extend over a guide roll 16 and two rolls 54. They meet at a further point in the machine, as will be described. In order to keep the two warp sheets of warp ends distinct, the upper sheet 15 is shown in dashed lines coming from the beam 13, and the lower sheet 17 is in dashed lines coming from a lower beam 14. The feed of warps for non-woven fabrics of the type to which the present invention relates are known; and therefore, this portion of the machine, which is not substantially changed by the present invention, is a purely diagrammatic showing since the invention is not concerned with the mechanical details of the warp end feeds. It will be noted that FIGS. 1 and 1A illustrate a machine in which two warp sheets are provided with wefts laid between them to form a sandwich, as best seen in FIG. 1, and as will be described further below. A single warp sheet, for example coming from the lower beam 14, can be used where it is desired to have only one layer of warps. More than two, of course, will require a corresponding number of sheets. As is common in non-woven fabrics, the warp ends of the upper sheet 15 and lower sheet 17 are staggered. This, of course, does not show in FIG. 1. The present invention is not concerned with the exact mechanism for feeding warp sheets as this is not changed. The common source from beams is illustrated in FIGS. 1 and 1A, but of course any other known type of source supplying warp sheets may be used, such as creels with separate warp end packages, and the like. These other sources of supply of warp sheets or layers are well known and are not changed by the mechanism of the present invention any more than the beams, which are actually illustrated in FIGS. 1 and 1A. These other known sources for warp sheets are, therefore, not illustrated as they would only confuse the drawings, but it should be understood that the present invention is not limited to the typical source of supply from beams actually illustrated.

Figure 21:
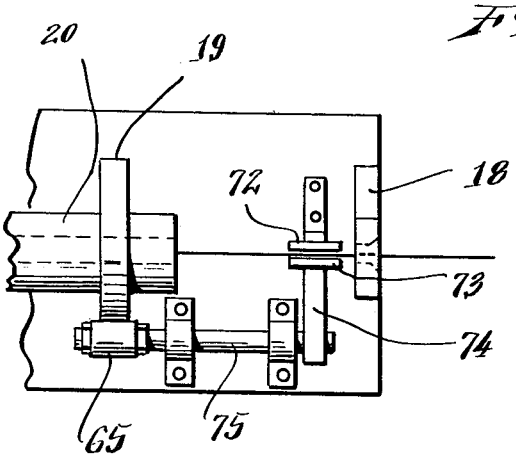
FIGS. 21 to 23 are enlarged details of the intermittent tensioning means which appear more generally and diagrammatically on FIGS. 1 and 1A.
Figure 22:
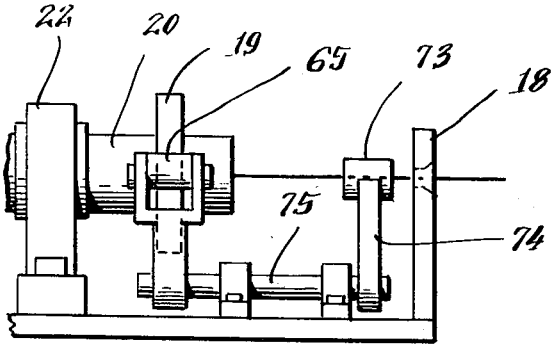
Figure 23:
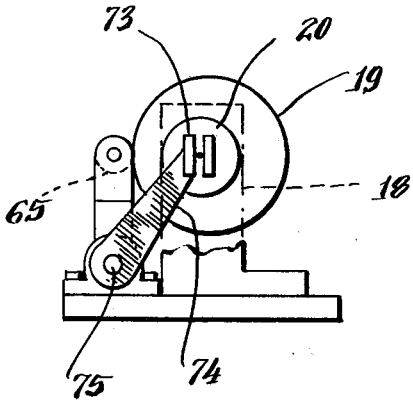

Weft yarn from the package 10 enters the hollow shaft 20, which is rotated by the chains or notched belts 6. This shaft is supported in bearings 22 on the ends of the upwardly projecting frame 52. The yarn from the package 10 passes through an intermittent tensioning device 18, which is cam driven from the cam 19 that rotates with the shaft 20. The cam 19 is set initially so that the tensioning device is operated at the proper intervals. While the tensioning device design by itself is not a new mechanism, it is needed in the combination of the present invention and so will be described in more detail than in FIGS. 1 and 1A in FIGS. 21 to 23. The yarn enters the tensioning device 18 through a guide opening and passes between two tension discs 72 and 73, which can best be seen in FIGS. 21 and 23, which are elevations taken at right angles to each other. FIG. 22 shows in more detail the drive from the cam 19 to the movable disc 73. This is most clearly shown in FIGS. 22 and 23. The drive of the cam 19 is from shaft 20 on which the cam is mounted. The drive of the hollow shaft 20 will be described in more detail below in connection with FIGS. 1 and 1A. It appears in FIGS. 21 to 23 but only a short portion is shown in those figures. The cam 19 is provided with a cam follower 65 which is connected to a shaft 75 and causes the latter to oscillate through a very small arc as the cam 19 has a very gentle profile since the tension discs do not have to be moved any great distance. The exact profile of the cam 19 is not shown on the drawings in order not to confuse them as it is a well known element, the exact design of which forms no part of the present invention. At the other end of the shaft 75 there is mounted an element or finger 74 which connects to the movable disc 73. The operation can best be seen in FIGS. 22 and 23. When the yarn is to be tensioned for short intervals, of course the element 74 brings the two tension discs together, and during the periods when no tension is desired moves them slightly apart. Since the cam 19 is on the shaft 20, it will be apparent from the descriptions below that its movement is synchronized with various positions of the wand, which will be described.

Figure 11:
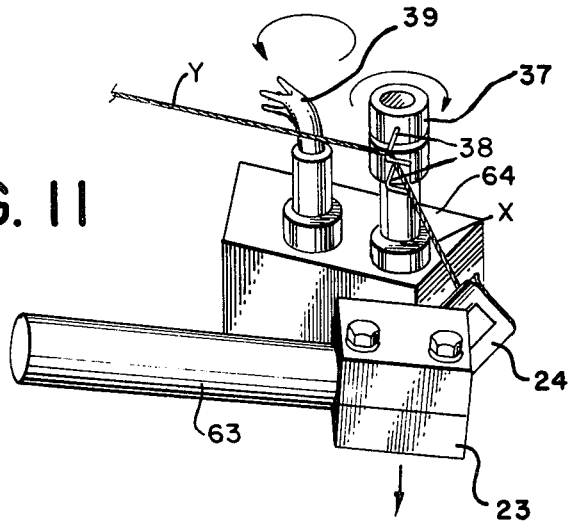
FIGS. 11 to 15 show different positions of the yarn transfer mechanism at the right hand side of the machine.

The weft yarn, after passing through the intermittent tensioning device 18, the operation of which has just been described, continues through the hollow shaft 20 into a hollow wand 23, which is turned by the shaft 20 and which is provided with a counterweight 55 to prevent vibration during operation because of unbalanced loads. At the end of the wand 23 there is a weft yarn guide in the form of a feeding head 24. This is best seen in FIG. 11, but in order not to confuse the drawing of FIG. 11 the yarn coming out of the head 24 is not shown in this figure but is diagrammatically indicated in FIG. 11A.

Figure 16:
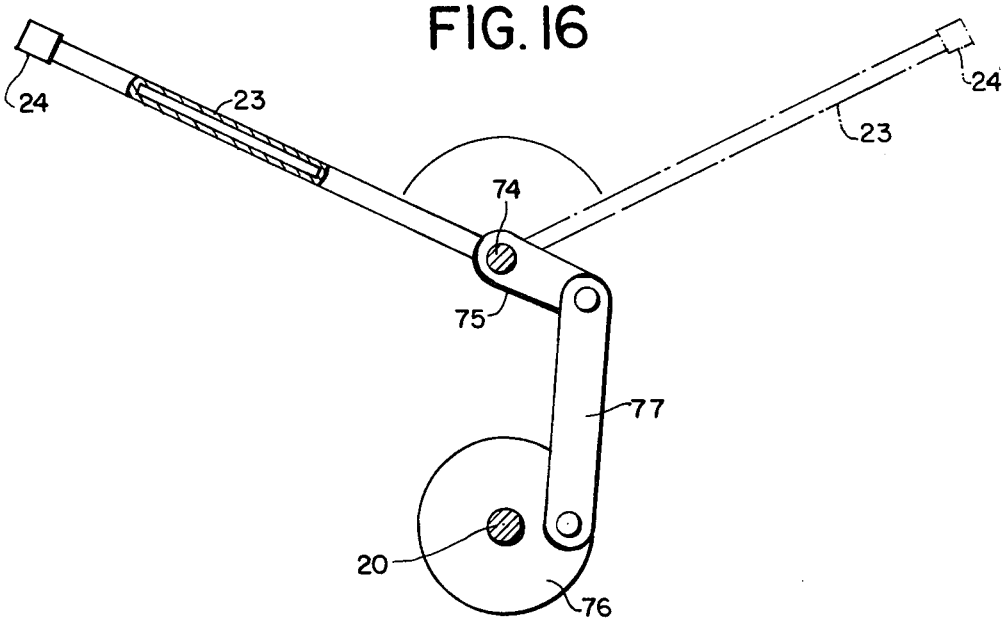
FIG. 16 is a diagrammatic illustration of a drive permitting oscillation of the wand instead of continuous rotation.

As the wand 23 rotates, as can be seen clearly from the diagrammatic positions in FIGS. 5A to 15A, the rotation being clockwise as is shown by the arrow in FIGS. 5A to 7A, the wand successively comes adjacent to two weft carrying means in the form of endless chains 25 and 40, only the left hand chain 25, of course, showing in FIG. 1. In the following description the right and left hand designations assume that one is standing at the right side of FIG. 1 and looking through the machine along the axis of the hollow shaft 20. This hollow shaft is midway between the two chains 25 and 40, as can be seen in FIG. 1A, so that as the wand 23 turns, its head 24 will approach each chain at the proper point. The yarn leaving the head 24 is moving in simple harmonic motion and, as a result, slows down as it approaches each chain, actually stopping for a very brief moment. As a result, transfer to the hooks on chains 25 and 40 occurs while the yarn is moving very slowly. It will be apparent that the simple harmonic motion is the movement of the yarn and not of the head 24, which in all of the figures except FIG. 16, is moving at uniform speed as it approaches each chain, the speed being the same throughout the movement of the wand between chains.

Figure 4:
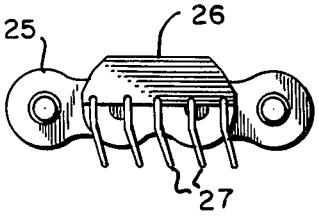
FIG. 4 is a similar view of one link at right angles to FIG. 3.
Figure 4A:
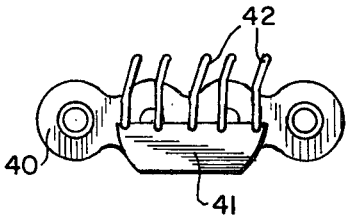
FIG. 4A is a view similar to FIG. 4 for the right hand chain.

The chains 25 and 40 carry plates 26 and 41 with weft loop retaining means, such as hooks 27 and 42. It should be noted that the ends of the hooks are slightly rounded and are not sharp points. This mechanism is most clearly shown for the left hand chain in FIGS. 2 and 3. FIGS. 4 and 4A show the chain for both left and right hand chains but it also appears, though in less detail, for the right hand chain in FIGS. 13 and 15 and for the left hand chain in FIGS. 6 to 10. As the right hand position shown in FIGS. 11 to 15 is isometric, the right hand chain is not shown in FIGS. 11 and 12 in order not to confuse the drawings, as in the positions shown in these figures the chain is not actively involved.

Figure 2:
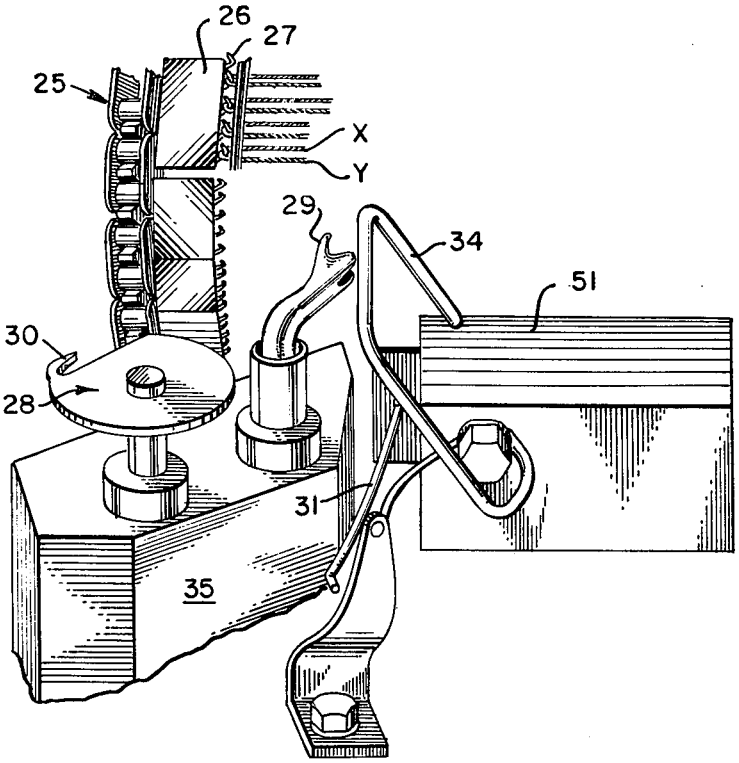
FIG. 2 is an enlarged view of portions of the mechanism for transferring weft yarn at the left hand side of the machine.
Figure 3:
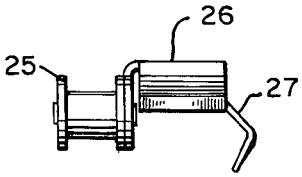
FIG. 3 is a detail of one link of the carrier chain with plate and hooks.

FIG. 2 illustrates semi-diagrammatically the left hand transfer mechanism. This involves a housing 35 which carries two counter-rotating elements 28 and 29 driven from the chain 4. FIG. 1 best illustrates that the chain 4 is driven from the shaft 20 through a chain 21, a jack shaft 58, a chain 59, a short shaft 61, and through a gear box 62 to a shaft 63. The details of the drive of this shaft and the elements in the housing 35 for the left hand transfer mechanism and 64 for the right hand mechanism will be described in detail further below in conjunction with FIG. 1B. Element 28 is a disc with a single finger 30, and element 29 is a forked finger. The two fingers rotate in opposite directions with proper synchronization, as can be seen in FIGS. 5 to 10. As will be seen in the more detailed description of FIGS. 5 to 9 below, weft yarn is transferred by the transfer mechanism from the head 24 of the wand 23 to the proper hook 27. Since this transfer involves looping the weft yarn around fingers, and eventually around a hook, it is important for clarity in FIGS. 5 to 9 to distinguish the two portions of the yarn, and for this purpose the portion of the yarn which has been laid down by the movement of the wand in its lower semicircle is designated X and the further end of the yarn which is moving back as the wand goes through its upper semicircle, the positions being shown in FIGS. 5A to 9A, is designated Y. This is clearly shown in FIGS. 5 to 9, but in FIG. 2 only the yarns which have been looped around hooks quite a ways along the chain are shown, broken away, in order not to confuse the drawing of FIG. 2 showing the moving fingers.

It can be seen from FIG. 2 that the yarns X and Y are quite closely spaced, and by inspection of FIGS. 4 and 4A it will be apparent that this spacing is less than the length of each hook 27. FIGS. 4 and 4A, as is the case with FIG. 2, are not working scale drawings but they are in correct relative scale from which it can be seen the hooks 27 are about twice as long as the spacing between them.

Figure 5:
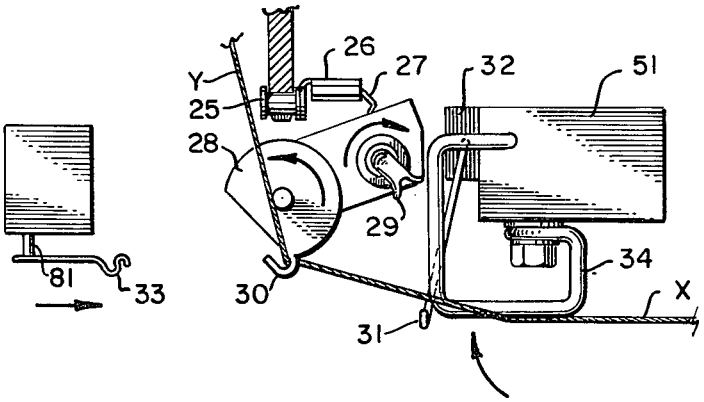
FIGS. 5 to 10 show the mechanism of FIG. 2 in different positions. Correspondingly.
Figure 5A:
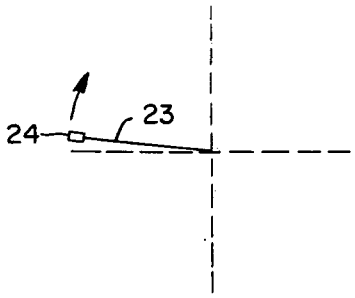

Turning to FIG. 5, which represents the position just as the wand has approached the left hand transfer mechanism, diagrammatically illustrated in FIG. 5A, the yarn has been laid in the finger 30, the portion to the right, of course, being designated X and the other portion Y. At this point two additional oscillating fingers are involved: One finger 31 is mounted on an oscillating disc 32 in a framework or housing 51, which on FIG. 1 is a part of the housing 35, which in that figure is shown as representing the whole of the drive for the left hand transfer mechanism. This portion of FIG. 1 is not shown in detail and is purely diagrammatic. In FIG. 5 it will be seen that the finger 31 is just ready to grasp weft yarn X. To the left there is shown another finger 33 which moves from left to right and back, as shown in FIGS. 5 to 9. The motion is by conventional means and the details of the mechanism in housing 35 of FIG. 1 are, therefore, not shown in order not to confuse the drawing. Of course finger 33 is moved in synchronism with the rest of the operation, which results automatically from the drive from the chain 4 through the other drive element described above. A stationary wire or guide 34 is also mounted on the housing 51. Strictly speaking, this is not a part of the moving transfer mechanism, but it performs the useful function of keeping the yarn from tangling with the moving elements of the transfer mechanism. This will be apparent from FIGS. 5 to 10.

Figure 6:
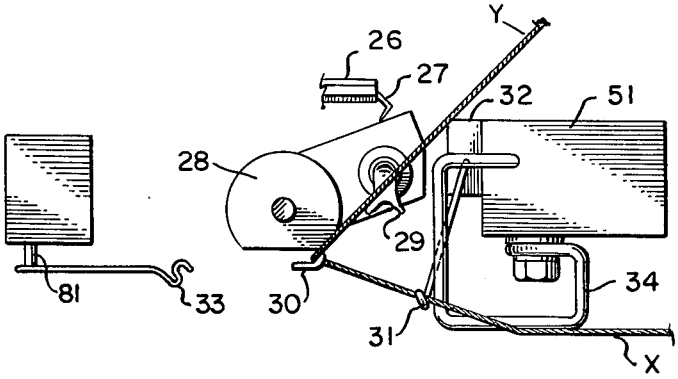
Figure 6A:
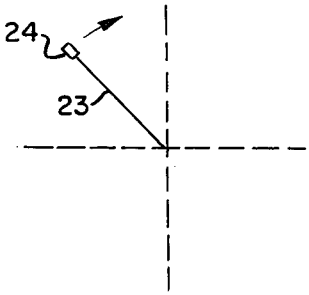

In FIG. 6 there has been some further turning of the disc 28 and forked finger 29, and the finger 31 is shown as having engaged the weft yarn X and beginning to move it up. The finger 33 is also shown just before it engages the weft yarn Y. It will be noted that FIGS. 5 to 10 are top views and do not show the forked finger 29 fully. This finger is fully seen in the perspective view of FIG. 2. On the right hand side of the machine there is a forked finger 39, which is of the same shape as forked finger 29 on the left hand side of the machine. The operation of the fingers on the right hand side of the machine will be described in more detail below.

Figure 7:
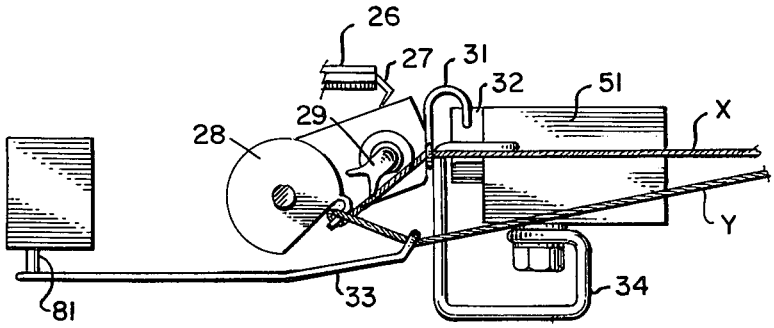

FIG. 7 shows finger 30 about ready to release the yarns onto the forked finger 29, finger 33 holding yarn Y to about its furthest point to the right. Finger 31 has raised the yarn X to the top position. Part of the forked finger 29 is now about to go under yarn X and another part over yarn Y.

Figure 8:
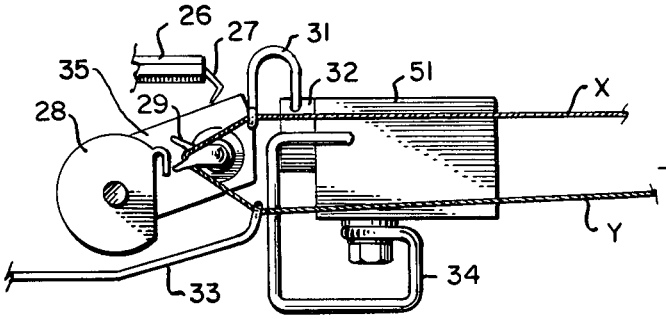
Figure 8A:
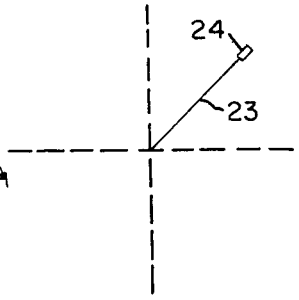

In FIG. 8 the wand 23 is about half way in the second part of its upper arc, as can be seen from FIG. 8A. Finger 31 is still holding yarn X at about its top position, and the coaction of fingers 30, 31 and 33 has transferred yarns X and Y to the forked finger 29. It will be noted that the half twist of the yarns about finger 30 in FIG. 7 still remains although the loop around finger 30 has just been released. Yarn X is still over part of the forked finger 29, just as in FIG. 7, and yarn Y is underneath both left hand tines of the upper and lower forks in the vertical plane. As FIG. 8 is a view looking down, the split of the forked finger 29 into an upper and lower fork does not show; however, this is clearly shown in FIG. 2, and the yarn Y is under both upper and lower forks and between left and right hand tines.

It will be noted from a consideration of FIGS. 7 and 8 that the fingers have resulted in giving the weft yarn a half turn. Where it is important that the wefts be laid parallel, this half turn is necessary as otherwise the yarns X and Y would cross.

Figure 9:
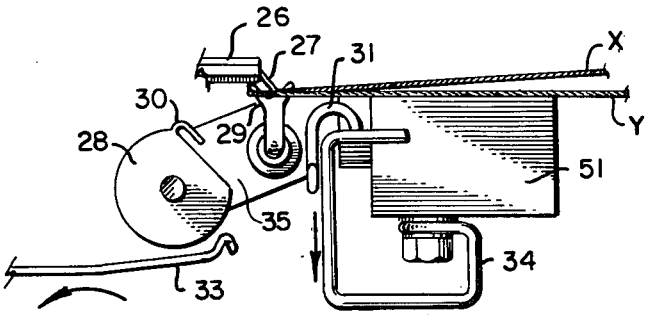
Figure 10:
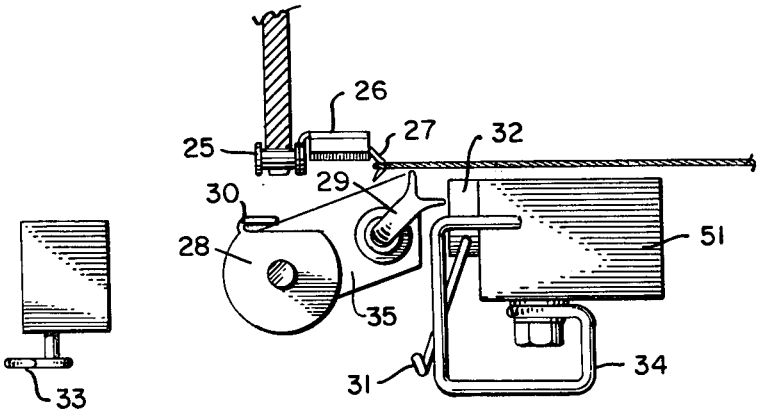

FIG. 9 shows the yarn loop almost completely transferred to the hook 27. Finger 33 has moved back; finger 30 has released the yarn, and finger 31 has moved part way down. These movements are clearly shown in FIG. 9. FIG. 10 shows the completion of the loop of yarns X and Y around the hook 27, and this loop has been released from the forked finger 29. Because of the view in FIG. 10, the yarns X and Y are no longer visible as separate yarns, but this is shown in FIG. 2 and of course appears in FIGS. 5 to 9.

In FIGS. 2 and 8 to 10 the motion of the fingers 31 and 33 are shown without the details of their drive although in FIG. 10 there is shown diagrammatically an element and shaft. This purely diagrammatic showing is for the purpose of making the figures of the drawings clear and unconfused. The actual drive will be described in a typical illustrative form further below in connection with FIGS. 1B and 17 to 20.

Figure 9A:
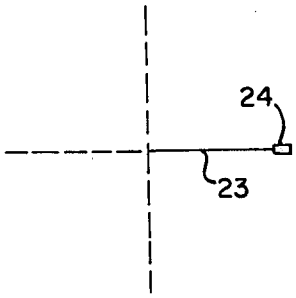
Figure 10A:
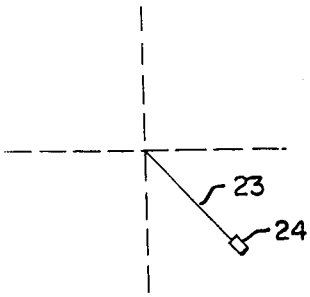
Figure 11A:
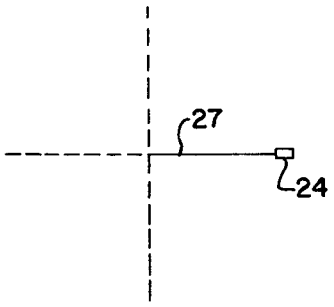
Figure 12:
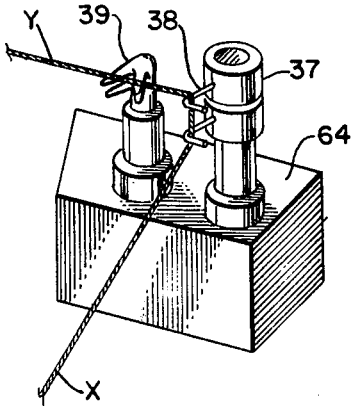
Figure 12A:
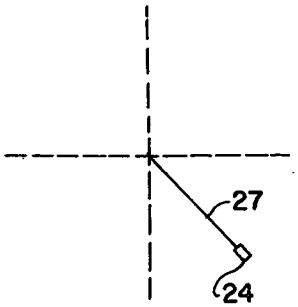
Figure 13:
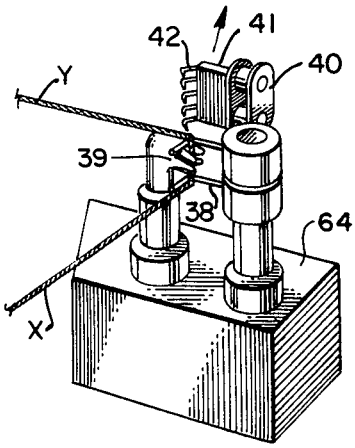

FIG. 11A shows the wand 23 as it approaches the right hand transfer fingers, which are shown in FIG. 11. This is the position of the wand which is also shown in FIG. 9A. FIG. 10A shows the wand in the same position as FIG. 12A to illustrate what has happened in this position at the left hand side of the machine. FIG. 11, which incidentally shows the position of the wand 23 and its head 24, shows that the wand has laid yarn Y, the yarn which is laid down in the upper semicircular movement of the wand, on two hooked fingers 38 in two turning discs 37 and a forked finger 39, of the same design as finger 29. The fingers 38 take the place of the rotating elements 28 and 30 on the left hand side of the machine, and no oscillating fingers 31 and 33 are required on the right hand side of the machine because there is no half turn of the yarn as it is looped around the hooks 42 of the right hand chain 40, which hooks are on plates 41, shown in FIG. 4A. The chain is shown in FIG. 13 but does not appear in FIGS. 11, 12 and 14 in order not to confuse the drawings, as in these positions the yarn is not being transferred or looped around the hooks 42. For the same reason, the wand 23 is shown only in FIG. 11 and of course in the position FIGS. 11A to 15A. It will be noted that the hooks 42 are fastened to the chain 40 in essentially similar manner to the hooks 27 on the chain 25 on the left hand side of the machine. In both cases the hooks are angled in two places so that when the chains 25 and 40 turn around their end sprockets, as shown for chain 25 on FIG. 1 as sprocket 56, the loops of weft yarn drop off the hooks smoothly without catching. This point of the operation of the machine will be described below.

FIGS. 12 to 15 show different positions of the hooked fingers 38 and forked finger 39 as the weft yarn is transferred to its appropriate hook 42. It will be noted in FIGS. 11 to 15 that the positioning of the two hooks on the hooked finger 38 are such that they cause the yarn to straddle the fork in the finger 39 so that it is always reliably caught. When the wand continues beyond the position in FIG. 15A, it again approaches the left hand side of the machine, and the operations above described are repeated. It will be noted that the yarn is always designated X for the portion that is fed out in the arc of the wand in its bottom semicircle and Y in the top semicircle.

Figure 7A:
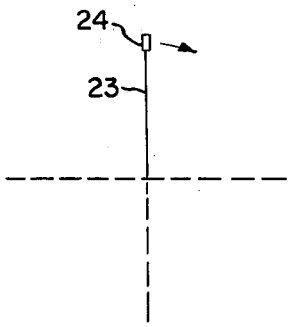
Figure 13A:
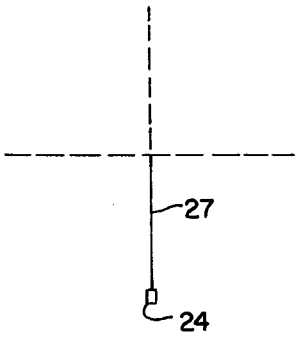
Figure 14:
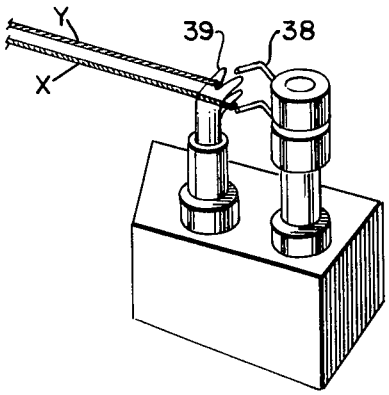
Figure 14A:
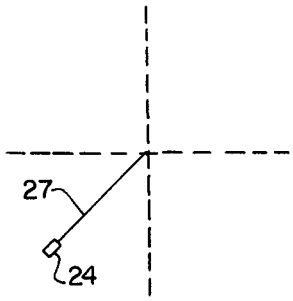
Figure 15A:
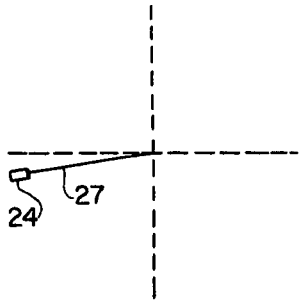
Figure 15:
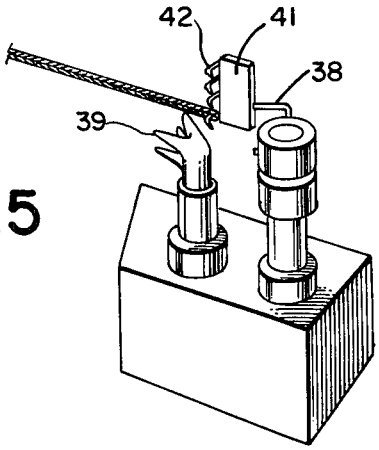

As has been mentioned above, while the wand rotates continuously and rapidly, the movement of the yarn from its head 24 is in simple harmonic motion and is, therefore, quite slow, and in fact actually stopped for a brief instant, as it is transferred to the finger 30 at the left and hooked fingers 39 at the right side of the machine. During the rest of the semicircular arcs of the wand, yarn is fed out more rapidly, the rate of feed and hence speed of yarn movement of course being a maximum at wand positions shown in FIGS. 7A and 13A. While maximum speed of yarn movement occurs as shown in FIGS. 7A and 13A, there is rapid acceleration from the pause at the yarn transfer point. When the yarn is feed out rapidly, and/or rapidly accelerates, the tension mechanism 18 is released, and there is little, or negligible, tension on the yarn. However, as it approaches the two positions where it transfers yarn to the left and right hand transfer fingers, tension is applied for a short period so that the yarn is pulled out straight and does not sag. This tension does not exert excessive strain on the yarn because, as has been pointed out above, at these positions the yarn is moving very slowly.

It has been mentioned above in the more general description of the invention that the wand can oscillate instead of rotating through a continuous circle. This is not preferred as it requires additional mechanism but it is thoroughly operative, and of course in such a case it is unnecessary that the yarn be given a half turn at the left hand side of the machine, as has been described. In such a case, instead of a single finger 30 with the fingers 31 and 33, which gives the yarn a half twist, the latter two are eliminated and a pair of fingers of the same form as the hooked fingers 38 on the right hand side of the machine may be used. With a continuously rotating wand this modification will lay wefts which cross each other. A semi-diagrammatic illustration of a typical oscillating drive, using conventional elements, is shown in FIG. 16 and will be described in more detail in connection with this figure further below.

Turning again to FIGS. 1, 1A and 2, it will be apparent that the weft yarns are held between the chains substantially parallel between the hooks and that they cannot move longitudinally, and of course cannot cross each other. The chains 25 and 40 carrying the wefts are driven by the shaft 78 which is driven from the jack shaft 58, referred to above, through a second chain 60, a speed reducer 80, and a chain 79. The reduction in speed is required because the chains 25 and 40 move more slowly than the wand 23, and the speed reducer 80 obviously has to provide the proper speed reduction to maintain synchronism. The drives are best shown in FIG. 1. The parallel layer of wefts is then moved to the left in FIGS. 1 and 1A until it strikes the two warp sheets at a point where they come together at the pair of rollers 2, appearing somewhat as a fell in the shed of warps on an ordinary loom. The warps are now on either side of the wefts, but the latter cannot move longitudinally and therefore do not tend to move the warps transversely. In other words, the fabric, although not locked, moves forward without slippage of the warp and weft threads. It is now slightly depressed by a short roller 44, which is shorter than the distance between the chains, and in this position is pressed below the level of an adhesive or other coating composition in a trough 45. This results in coating the fabric while it is still held with the wefts parallel between the hooks on the chains 25 and 40. The amount by which the fabric is moved down is so small that the elasticity of the fabric permits it; and at the same time, since the roller 44 and the trough 45 are shorter than the distance between chains, the coating composition is not smeared on the hooks. In other words, the short loops of weft on the hooks may be considered as analogous to a very narrow dry selvage. The fabric has excess coating composition squeezed out into the trough 8 by conventional nip rolls 7, as shown in FIG. 1. Nip pressure is provided in the usual way by the tension cylinder 46. The fabric passes through a heated zone 57 and along to a shoe 53 which releases the wefts in the fabric from the loop retaining means. The fabric then passes to the take-up roll 48. The weft releasing means in the form of a shoe 76 is preferred. However, the loops may be released from the weft loop retaining means by other equivalent devices. For example, the dry selvage along and parallel to the weft retaining means may be cut with a knife. These alternative means are not shown in the drawings, which are directed to the preferred form of loop releasing means, namely, a shoe. The temperature of the zone 57 is such that the coating or adhesive composition is set and the fabric comes off the shoe 53 onto the take-up roll 48 which is in the projecting frame 49. The tension is maintained by conventional means.

The particular design of the elements applying coating composition to the fabric is not the essence of the present invention in its non-woven fabric aspect. The form of coating described above is a satisfactory and useful means but other coating means may be employed, such as, for example, coating rolls. The important thing is that the coating composition be applied to the fabric while the wefts are still held in parallel position by the hooks on the chains 25 and 40 so that the non-woven fabric is held against any significant distortion until it has been coated and the coating has set sufficiently to hold the fabric in its proper form.

FIG. 1B illustrates in more detail the drive for the carrier chains and for the transfer means which transfers the yarn from the wand to the hooks on the carrier chains 25 and 40. This figure should be read in conjunction with FIG. 1A, which has been described above. It shows the shaft 74 which drives the chains 25 and 40 but in order not to confuse the drawings the chains themselves are not shown. Shaft 63, as has been described above in connection with FIG. 1A, is driven through chains, jack shaft and a gear box. On FIG. 1B the shaft at the right is shown extended and leads, of course, to the gear box 62.

Figure 17:
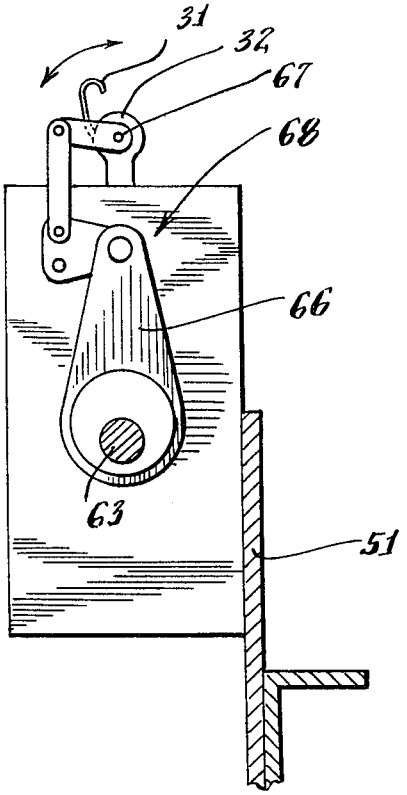
FIGS. 17 to 20 are enlarged details of various elements and drives shown principally on FIG. 1B, portions being broken away so that the mechanisms can clearly be seen.

Turning to the left hand portion of the figure, the description should be read in connection with FIG. 17, which illustrates the elements of the drive in greater detail. This sequence of operations includes drives for the transfer means for transferring yarn to the hook on the left hand chain, the shaft driving an eccentric 66 which through linkage 68 oscillates the shaft 67. On the end of this shaft there is a disc 32 which carries the finger 31, which can be seen also in FIG. 2. The oscillation produced by eccentric and linkage causes the shaft to oscillate and therefore moves the finger 31 to various positions which are shown in FIGS. 5 to 10.

Figure 18:
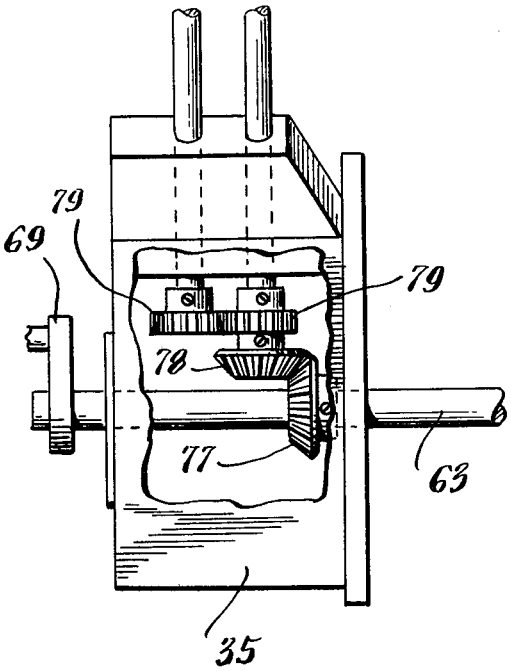
Figure 20:
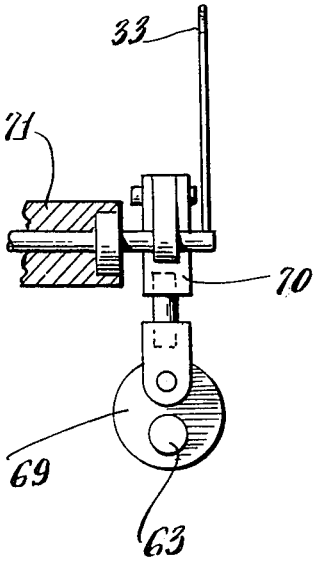
Figure 19:
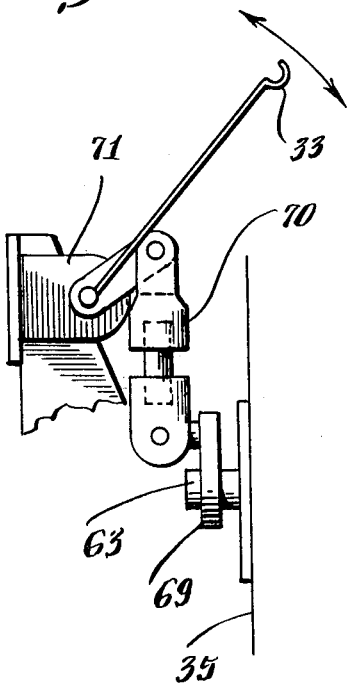

The shaft 63 extends on further into the gear box 35, which is the gear box showing the drive of the two transfer mechanisms in FIG. 2. As described, there are gears driving these elements in opposite directions. FIG. 18 shows the drive in greater detail, part of the box 35 being broken away to show the gears. There is a bevel gear 77 on shaft 63 which meshes with another bevel gear 78 driving two vertical shafts with a pair of spur gears causing the two shafts to rotate in opposite directions. These are the two shafts which turn the fork 29 and the disc 28, respectively, as shown in FIG. 2 and also indicated in FIGS. 5 to 10.

The shaft 63 extends on through the gear box 35 and at its end carries an eccentric 69, which causes an oscillating motion to the finger 33, which can be seen in various positions in FIGS. 5 through 10 and its function is described in connection with those figures. It will be noted that the oscillation of the element 71 occurs through universal joint 70. The details of the drive are illustrated in more detail in FIGS. 19 and 20. The universal joint 70 is desirable as there is some slight sideways movement of the finger 33 which might bind a linkage that does not have a universal joint incorporated in it. The amount of departure from a straight line is very small and in FIG. 1B it is shown in a position where there is essentially a straight line.

The housing containing the drive for oscillating the finger 33 is shown more diagrammatically in FIG. 1B although a portion of this figure is shown broken away so that the eccentric 69 can be seen. The particular design of this drive is not what distinguishes the invention from the prior art and FIGS. 1B, 19 and 20 simply illustrate a typical operative form without limiting the invention thereto.

FIG. 16 illustrates an oscillating drive for the wand 23 with its head 24. This is effected from the shaft 20 by a disc 76 thereon pivoted to a link 77 and acting therefor as an eccentric. The link 77 is pivoted in a link 75 which is rigidly fastened onto a shaft 74 on which the wand 23 is mounted. The result is an oscillation of the wand symbolized by a curved arrow. Two positions are shown, one in solid lines and the other in dot-dashed lines. As in the case of the continuously rotating wand, it is hollow, which is shown in FIG. 16 where a portion of the wand is broken away. In FIG. 16 the wand oscillates, and therefore, because of the eccentric 76, it moves in a simple harmonic motion, stopping briefly in the extreme position, which is adjacent to the hooks on the chains 25 and 40. In other words, in FIG. 16 it is not only the yarn extending from the head 24 which moves in simple harmonic motion but the wand and its head do also. This, of course, results in a slowing down of the movement of the head and with it the yarn as it approaches the carrier chains with their hooks.

As has been described above, an oscillating wand does not require imparting a half twist to the yarn as it is looped around the hooks on one chain. Therefore both transfer means are of the type shown in FIGS. 11 to 15 but the yarn is still laid parallel without crossing. It will be noted that the drive of the shafts for both transfer means through the gear boxes is the same but the nature of the spaced hooks 38 and the transfer forked finger 39 is what causes the yarn to be looped around the hooks without imparting a half twist thereto. It is obvious from considering FIGS. 11 to 15 that there is no drive of fingers 31 and 33 which produce the half twist. This makes the oscillating drive from eccentric 66 which is shown in FIG. 1B unnecessary and so when the modification of FIG. 16 is used this portion of the mechanism shown in FIG. 1B is eliminated.

While the transfer mechanism with an oscillating wand is somewhat simpler in that no half twist is required, the problems of oscillating the wand introduce sufficient additional complication so that the speed of the machine may be reduced. For this reason, as has been indicated above, the modification of FIGS. 1, 1A, and 1B with a continuously rotating wand is preferred.

The present invention has been described in conjunction with the production of non-woven fabrics, which is its most important field at the present time. However, the improved apparatus for stringing wefts across weft carrying means such as carrier chains can be used in machines for producing warp and cross laid weft fabric of any type. For example, the same mechanism for stringing and transporting wefts can be used in weft inserted warp knitting machines. In such a case normally the modification of the present invention in which the wefts on the weft carrying means are parallel and do not cross is preferable. Of course in such an operation where there is actual locking of warp and weft it is normally not necessary to lock the two types of yarns by adhesives or other means.

When the weft stringing and carrying features of the present invention are used with a different type of fabric forming machine, particularly a weft inserted warp knitting machine, it is an advantage that the knitting part of the machine is not changed. The present invention in such a case merely inserts parallel wefts and the knitting properly proceeds without significant apparatus modification being essential. This makes it possible to incorporate the weft stringing and carrying features of the present invention in existing fabric forming machines and adds a desirable flexibility. It is not necessary to build a new fabric making machine although, of course, the features of the present invention can be incorporated in such a new construction where desired.

I claim:

1. In an apparatus for forming fabric of the warp and cross laid weft type, which apparatus includes means for supplying warp yarns in the form of at least one sheet and means for forming aligned wefts and transporting them to lay across the warps, the improvement which comprises, a. the means for forming and transporting aligned wefts comprising two aligned weft carrying means for carrying aligned wefts, said carrying means being provided with weft loop retaining means, the spacing of the weft loop retaining means being shorter than the dimension of the means, a source of at least one weft yarn, means for stringing weft yarn from weft loop retaining means on one carrying means to weft loop retaining means on the other carrying means and means guiding weft yarn from said source to said stringing means, b. said means for stringing weft yarn comprising at least one yarn guide and means for moving said yarn guide along the periphery of a circular arc, the chord of said arc being substantially equal to the length of a weft, one end of said chord being adjacent to one weft carrying means and the other end adjacent to the other weft carrying means, c. moving transfer means for transferring loops of weft yarn from the guide moving along the periphery of the circular arc to the weft loop retaining means on the weft carrying means, whereby movement of the guide means along the circular arc lays wefts from weft loop retaining means on one weft carrying means to the other, d. means for releasing weft loops from the weft loop retaining means after the completion of the transport of the aligned wefts, e. the moving transfer means for laying wefts onto the weft carrying means comprising a pair of counter-rotating elements adjacent each weft carrying means, the first of such elements of the first of the pairs thereof being a single unforked finger positioned to receive weft yarn from the end of the yarn guide means, the second counter-rotating element of the first pair being a forked finger positioned to receive the weft yarn from said first counter-rotating element and to transfer it, in the form of a loop, to the weft loop retaining means on one carrying means, said forked finger having an upper and lower fork, a vertically oscillating engaging means positioned to engage the weft yarn transferred to the single unforked finger and to raise it above the forked finger, and a horizontally oscillating means positioned to engage the weft yarn after it has been received by the first counter-rotating element and maintaining it in a position below both forks of said forked finger, both oscillating means being synchronized to hold the yarn during transfer from the first counter-rotating element to the second counter-rotating element, whereby coaction of the two oscillating engaging means and the counter-rotating elements results in a twisted loop around the first counter-rotating element, which loop, when transferred to the second counter-rotating element and from said second counter-rotating element to the weft loop retaining means, effecting a half twist of the yarn, and f. all of the means effecting motions being synchronized.

2. An apparatus according to claim 1 in which the means for moving the yarn guide along the periphery of a circular arc comprises a hollow wand with the yarn guide at an end, driving means at the other end, said driving means comprising a hollow drive shaft rotating continuously and communicating with the hollow wand, means for feeding yarn to the hollow drive shaft whereby yarn is strung between said rotating wand from weft carrier means to weft carrier means.

3. An apparatus according to claim 2 in which intermittent tensioning means are provided for the weft yarn guided through the hollow shaft to the wand, said tensioning means being synchronized with machine drive to apply tension for a short time when the wand end is adjacent the weft loop retaining means and is, therefore, feeding weft yarn at very slow speed, and releasing the tension during the remainder of the circular arc when the yarn is being fed rapidly.

4. An apparatus according to claim 1 comprising means to feed weft yarn to the center of the circular arc and thence to the yarn guide and means for applying intermittent tension to the weft yarn, said intermittent tensioning means being synchronized with machine drive to apply tension for a short time when the yarn guide is adjacent the weft loop retaining means and the yarn is, therefore, being fed at very slow speed and releasing the tension during the remainder of the circular arc when the yarn is being fed rapidly.

5. An apparatus according to claim 4 in which the second pair of counter-rotating elements are positioned adjacent the weft loop retaining means on the carrying means other than the carrying means receiving a half-twisted weft loop, one counter-rotating element of said second pair being a forked finger having an upper and a lower fork and the other counter-rotating element being a double hooked finger positioned to receive weft yarn from the yarn guide end, the hooks being positioned one above the upper fork of the forked finger and one below the lower fork, whereby the second pair of counter-rotating elements transfers a loop of weft yarn to the weft loop retaining means without twisting said loop and thus without forming a half twist in the weft.

6. An apparatus according to claim 1 in which the second pair of counter-rotating elements are positioned adjacent the weft loop retaining means on the carrying means other than the carrying means receiving a half-twisted weft loop, one counter-rotating element of said second pair being a forked finger having an upper and a lower fork and the other counter-rotating element being a double hooked finger positioned to receive weft yarn from the yarn guide end, the hooks being positioned one above the upper fork of the forked finger and one below the lower fork, whereby the second pair of counter-rotating elements transfers a loop of weft yarn to the weft loop retaining means without twisting said loop and thus without forming a half twist in the weft.

7. In an apparatus for forming fabric of the warp and cross laid weft type, which apparatus includes means for supplying warp yarns in the form of at least one sheet and means for forming aligned wefts and transporting them to lay across the warps, the improvement which comprises, a. the means for forming and transporting aligned wefts comprising two aligned weft carrying means for carrying alinged wefts, said carrying means being provided with weft loop retaining means, the spacing of the weft loop retaining means being shorter than the dimension of the means, a source of at least one weft yarn, means for stringing weft yarn from weft loop retaining means on one carrying means to weft loop retaining means on the other carrying means and means guiding weft yarn from said source to said stringing means, b. said means for stringing weft yarn comprising at least one yarn guide and means for moving said yarn guide along the periphery of a circular arc, the chord of said arc being substantially equal to the length of a weft, one end of said chord being adjacent to one weft carrying means and the other end adjacent to the other weft carrying means, c. moving transfer means for transferring loops of weft yarn from the guide moving along the periphery of the circular arc to the weft loop retaining means on the weft carrying means, whereby movement of the guide means along the circular arc lays wefts from weft loop retaining means on one weft carrying means to the other, d. means for releasing weft loops from the weft loop retaining means after the completion of the transport of the aligned wefts, e. the moving transfer means for transferring loops of weft yarn from the yarn guide comprising two pairs of counter-rotating elements, a pair of such elements located adjacent each weft carrying means, one of the pairs of such elements comprising a forked finger having an upper and a lower fork and the other counter-rotating element of such one pair being a double hooked finger positioned to receive weft yarn from the yarn guide end, the hooks being positioned one above the upper fork of the forked finger and one below the lower fork, whereby the second pair of counter-rotating elements transfers a loop of weft yarn to the weft loop retaining means without twisting said loop and thus without forming a half twist in the weft.

8. An apparatus according to claim 7 in which the means for stringing weft yarn comprises a hollow wand with the yarn guide at its end, a hollow shaft connected to the hollow wand at the center of the circular arc and means for turning the hollow shaft.

* * * * *